US008787588B2

(12) United States Patent
Ranganathan et al.

(10) Patent No.: US 8,787,588 B2
(45) Date of Patent: Jul. 22, 2014

(54) COUPLING OF SPEAKERS WITH INTEGRATED CIRCUIT

(75) Inventors: Sanjeev Ranganathan, Bangalore (IN); Shyam Somayajula, Bangalore (IN); Srinath Sridharan, Bangalore (IN); Arnold D'Souza, Bangalore (IN); Ramkishore Ganti, Bangalore (IN); Lionel Cimaz, Pleumeleuc (FR)

(73) Assignees: ST-Ericsson SA, Plan-les-Ouates (CH); ST-Ericsson PVT. Ltd., New Delhi (IN)

( * ) Notice: Subject to any disclaimer, the term of this patent is extended or adjusted under 35 U.S.C. 154(b) by 960 days.

(21) Appl. No.: 12/713,083

(22) Filed: Feb. 25, 2010

(65) Prior Publication Data

US 2010/0220868 A1 Sep. 2, 2010

(30) Foreign Application Priority Data

Feb. 27, 2009 (EP) ..... 09305181

(51) Int. Cl.
*H04R 1/10* (2006.01)
*H04R 5/033* (2006.01)

(52) U.S. Cl.
CPC ..... *H04R 5/033* (2013.01)
USPC ..... 381/74

(58) Field of Classification Search
CPC ... H04R 5/033; H04R 1/1041; H04R 2420/07
USPC ..... 381/74, 123, 120, 1, 17–22, 111–113, 381/122; 327/108
See application file for complete search history.

(56) References Cited

U.S. PATENT DOCUMENTS 8,170,237 B2 * 5/2012 Shajaan et al. ..... 381/113
2007/0279096 A1 * 12/2007 Chong et al. ..... 326/83

* cited by examiner

*Primary Examiner* — Lun-See Lao
(74) *Attorney, Agent, or Firm* — Howison & Arnott, L.L.P.

(57) ABSTRACT

Systems and methods for a low pin architecture to couple speakers with integrated circuits are disclosed herein. In an implementation, the low pin architecture facilitates in reducing the required pin interfaces to couple a low power speaker, a high power speaker, and earphone speakers with integrated circuits (ICs). For this, the high power speaker can be cross-coupled between the pin interfaces that are coupled to the low power speaker and the earphone speakers. These pin interfaces are driven by corresponding driver circuits. In said implementation, some of the driver circuits can be shared to drive multiple pin interfaces. These shared driver circuits include a combined cascode circuit having a first cascode circuit integrated with a second cascode circuit to reliably and selectively drive one or more of the pin interfaces.

8 Claims, 5 Drawing Sheets

COUPLING OF SPEAKERS WITH INTEGRATED CIRCUIT

BACKGROUND

1. Technical Field

The disclosed subject matter relates to coupling of speakers with an integrated circuit (IC).

2. Description of the Related Art

A spurt of advancement in various technologies has led to the genesis of highly sophisticated integrated circuits (ICs). In particular, the ICs manufactured for mobile handsets are in high demand due to an increase in the number of mobile phone users. A typical IC used in mobile phones, hereinafter referred to as mobile IC, includes a number of pin interfaces coupled with respective driver circuits. The pin interfaces are used to couple the mobile IC with other components, such as speakers, external memory and battery, to perform various input and output functions. Therefore, the pin interfaces of the mobile IC facilitate implementation of various features, such as audio/video calls, extended memory, Bluetooth, camera, etc., in a mobile phone.

More the number of pin interfaces that can be made available on a mobile IC, more would be the number of functionalities that can be provided. However, addition of pin interfaces is constrained by the space available on the mobile IC. Also, these pin interfaces are coupled to driver circuits, which occupy a lot of space in the mobile IC. Moreover, functions such as operations related to transceiver circuits and power management units (PMUs) of the mobile phone use a fixed number of pin interfaces. Therefore, efforts are being made to reduce the number of pin interfaces used for other functionalities, such as for coupling of speakers with a mobile IC.

The speakers generally supported by mobile IC pin interfaces include a high power speaker, a low power handset speaker, and earphone speakers. The handset speaker facilitates normal listening of voice calls, while the earphone speakers provide stereo playback of audio in audio/video applications, such as radio broadcast, music files and videos. On the other hand, the high power speaker is used for certain operations such as playback of Hi-Fi ring tones and sound amplification of voice calls. Several attempts have been assayed in the past to reduce the count of pin interfaces for the coupling of speakers with a mobile IC, for example by using shared driver circuits. However, such attempts escalated cross talk between the speakers and an unwanted variation in the performance metrics, such as noise, linearity, and power supply rejection ratio, of the mobile IC. Moreover, when shared driver circuit configurations were used, operation of the mobile IC over the entire range of supply voltage provided to the mobile IC became unreliable.

BRIEF SUMMARY

This summary is provided to introduce concepts related to a low pin architecture for coupling of speakers with an integrated circuit (IC) of a device, which is further described below in the detailed description. This summary is not intended to identify essential features of the claimed subject matter, nor is it intended for use in determining the scope of the claimed subject matter.

In an implementation, the low pin architecture can be implemented in ICs for mobile phones. A mobile phone can include multiple devices such as a low power speaker, a high power speaker, and earphone speakers, which can be coupled to an underlying IC using reduced number of pin interfaces. For this, the system comprises a first device coupled between a first and a second pin interface, and a second device that is coupled to the first pin interface and shares the first pin interface with the first device. Further, the system comprises a first driver circuit shared between the first pin interface and a third pin interface. The first driver circuit includes a first combined cascode circuit composed of at least two cascode circuits to selectively drive one of the first pin interface and the third pin interface. The first driver circuit is also coupled to a third cascode arm to selectively drive the second device through the first pin interface.

DETAILED DESCRIPTION

The disclosed subject matter relates to coupling of speakers with an integrated circuit (IC). More particularly, the subject matter relates to a low pin architecture for coupling of speakers with an IC. Such a coupling can be implemented in a variety of electronic or communication devices such as mobile phones, personal digital assistants (PDAs), music players, and so on.

In an implementation, the low pin architecture can be implemented in an IC connected to multiple speakers, for example, a low power speaker, a high power speaker and earphone speakers. The speakers can be coupled to an underlying IC using a reduced number of pin interfaces. For this, the high power speaker can be cross-coupled between the low power speaker and the earphone speaker to share the pin interfaces used for coupling the low power speaker and the earphone speakers. These shared pin interfaces can be driven by respective driver circuits implemented as cascode circuits in a shared driver circuit configuration. In the shared driver circuit configuration, a single driver circuit can drive multiple pin interfaces. During operation, some of the pin interfaces are driven while rest of the pin interfaces can be tri-stated. For this, the driver circuit has a combined cascode circuit including a first cascode circuit integrated with a second cascode circuit to selectively drive the required pin interfaces, while ensuring a reliable float voltage at the tri-stated pin interfaces.

Figure 1:
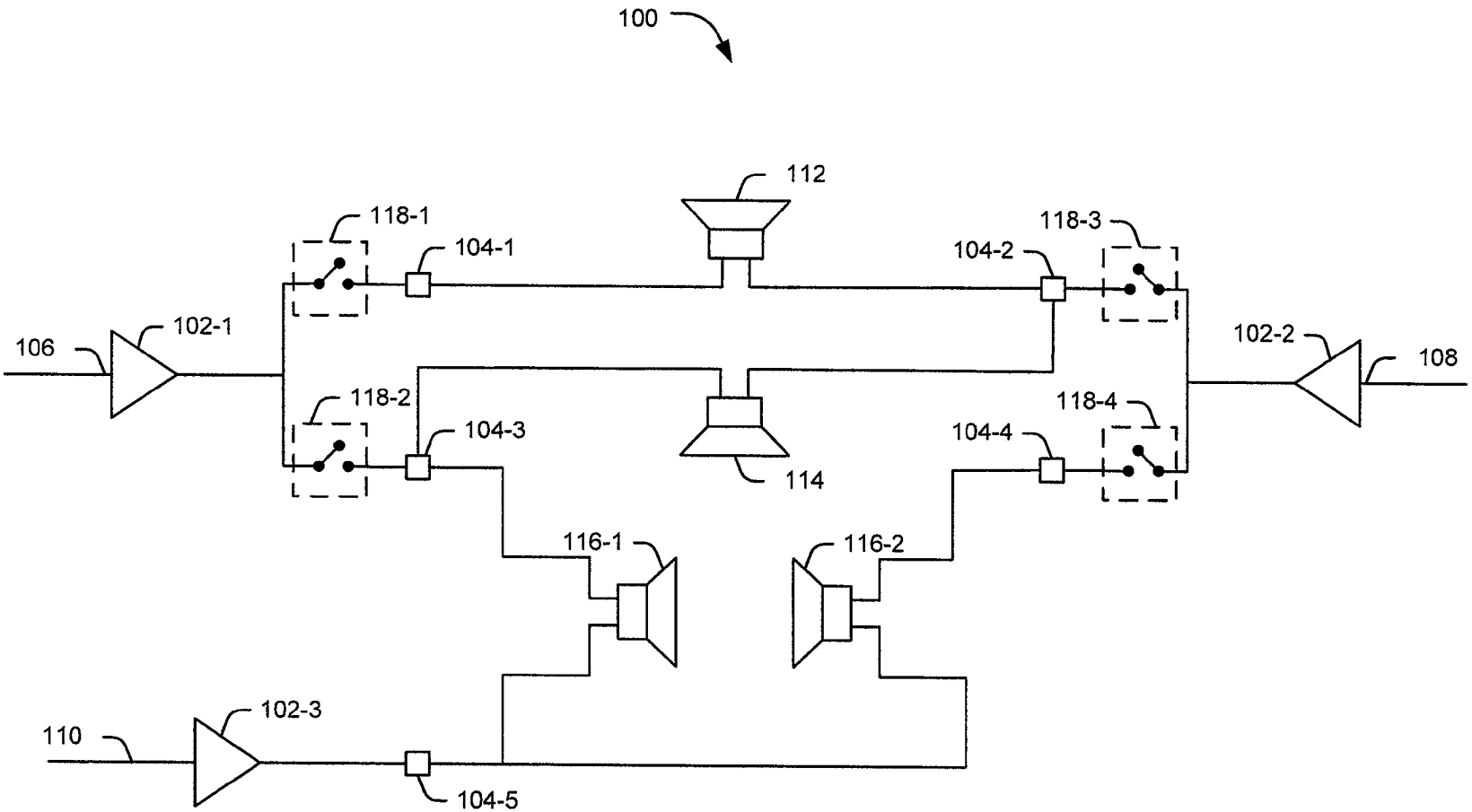
FIG. 1 illustrates a schematic diagram of an exemplary low pin architecture for coupling of speakers with an integrated circuit (IC).

The low pin architecture provides for a reduction in the count of pin interfaces required to couple speakers with the IC. This reduction in the number of pin interfaces used, allows for integration of additional features and functionalities with the IC. Further, the shared driver circuit configuration helps reduce the space constraint on the IC, thereby achieving a low packaging cost. The low pin architecture also avoids crosstalk between speakers without any alterations in performance metrics of the IC. Further, as compared to conventional shared driver circuit configurations, the described low pin architecture ensures a reliable float voltage at the tri-stated pin interfaces Exemplary Systems FIG. 1 illustrates a schematic diagram of an exemplary low pin architecture 100 for coupling of speakers with an integrated circuit (IC) for an electronic device, such as a mobile phone. In one implementation, the low pin architecture 100 includes multiple driver circuits, such as 102-1, 102-2, and 102-3, collectively referred to as driver circuits 102. The low pin architecture 100 also includes pin interfaces such as 104-1, 104-2, 104-3, 104-4, and 104-5, collectively referred to as pin interfaces 104. The pin interfaces 104 facilitate a variety of functions, such as signal transmission, power supply, etc., of the IC.

The driver circuit 102-1 can be fed with an input signal 106, while the driver circuit 102-2 can be supplied with an input signal 108. Further, the driver circuit 102-3 can receive an input signal 110 to provide a reference signal, for example, a common mode signal, as an output. The input signals 106 and 108 can be received from a plurality of sources such as a transceiver circuit, a general purpose input and output (GPIO) port, etc.

The pin interfaces 104 can be coupled to a variety of speakers such as a low power speaker 112, a high power speaker 114, and earphone speakers, 116-1 and 116-2, collectively referred to as earphone speakers 116. The low power speaker 112 can be coupled to the pin interfaces 104-1 and 104-2. The earphone speaker 116-1 can be coupled to the pin interfaces 104-5 and 104-3, while the earphone speaker 116-2 can be coupled to the pin interfaces 104-5 and 104-4. In an implementation, the high power speaker 114 can be coupled to the pin interfaces 104-3 and 104-2. In other words, the high power speaker 114 can be cross-coupled between the low power speaker 112 and the earphone speaker 116-1. In this way, as compared to conventional IC-speaker coupling architectures, the low pin architecture 100 facilitates coupling of the speakers 112, 114, and 116 with the IC using a lower count of pin interfaces 104.

Generally, the low power speaker 112 and the earphone speakers 116 provide audio output signals, which are orthogonal in nature, by virtue of which either the low power speaker 112 or the earphone speakers 116 are operational at a given time. As a result, there is no interference between the respective audio output signals of the low power speaker 112 and the earphone speakers 116. Therefore, the pin interfaces 104-1 and 104-2 coupled to the low power speaker 112 and the pin interfaces 104-3 and 104-4 coupled to the earphone speakers 116 can be driven through a shared driver circuit (SDC) configuration in the low pin architecture 100.

In the SDC configuration, the driver circuit 102-1 can be coupled to the pin interfaces 104-1 and 104-3, for example through respective switches 118-1 and 118-3, while the driver circuit 102-2 can be coupled to the pin interfaces 104-2 and 104-4, for example through respective switches 118-2 and 118-4. Due to such sharing of the driver circuits 102-1 and 102-2, the number of the driver circuits 102 required to drive the pin interfaces 104 can be reduced. Accordingly, the SDC configuration facilitates in reducing the space constraint on account of lesser number of driver circuits in the IC. Further, the driver circuit 102-3 can be coupled to a pin interface, for example, the pin interface 104-5, which is other than the pin interfaces that share the driver circuits 102-1 and 102-2.

The SDC configuration can, however, cause an unreliable float voltage to appear at the pin interface that is not being operated. To overcome this, the SDC configuration can be modified as discussed in the description of FIG. 2.

As mentioned above, typically, the low power speaker 112 and the earphone speakers 116 are operated mutually exclusively at a given time. Therefore, in said implementation, when the driver circuits 102-1 and 102-2 are activated, only two of the four coupled pin interfaces, for e.g., pin interfaces 104-1 and 104-2 or 104-3 and 104-4, are selectively activated for operation. This selective activation of the pin interfaces 104-1, 104-2, 104-3, and 104-4 is actuated by tri-stating the unwanted pin interfaces using methods known in the art, for example using the respective switches 118-1.118-4. For example, in case the pin interfaces 104-3 and 104-4 are to be operated, the pin interfaces 104-1 and 104-2 can be tri-stated.

In such a case, the output signal provided by the driver circuit 102-1 and received at the pin interface 104-3 can get superfluously transmitted to a tri-stated pin interface 104-2 through the high power speaker 114. This transmission of the output signal can hamper reliable operation at the pin interface 104-3 due to an associated voltage drop, via the high power speaker 114, at the pin interface 104-2. This voltage drop restricts the usage of the entire range of supply voltage at the pin interface 104-3. In other words, the tri-stated pin interface 104-2 may undergo a voltage swing that prevents a desired voltage from appearing at the pin interface 104-3, which is to be operated. The voltage swing refers to a voltage difference between maximum and minimum voltage levels at a given point.

A similar voltage swing can come into play when the pin interfaces 104-1 and 104-2 are to be operated. The pin interface 104-2 can lead to an unreliable operation due to transfer of an output signal, received from the driver circuit 102-2, to the pin interface 104-3. Therefore, in order to ensure reliable operation at the pin interfaces 104-2 and 104-3, the high power speaker can be implemented using a cascode arm, which will be explained in the description of FIG. 3.

Figure 2:
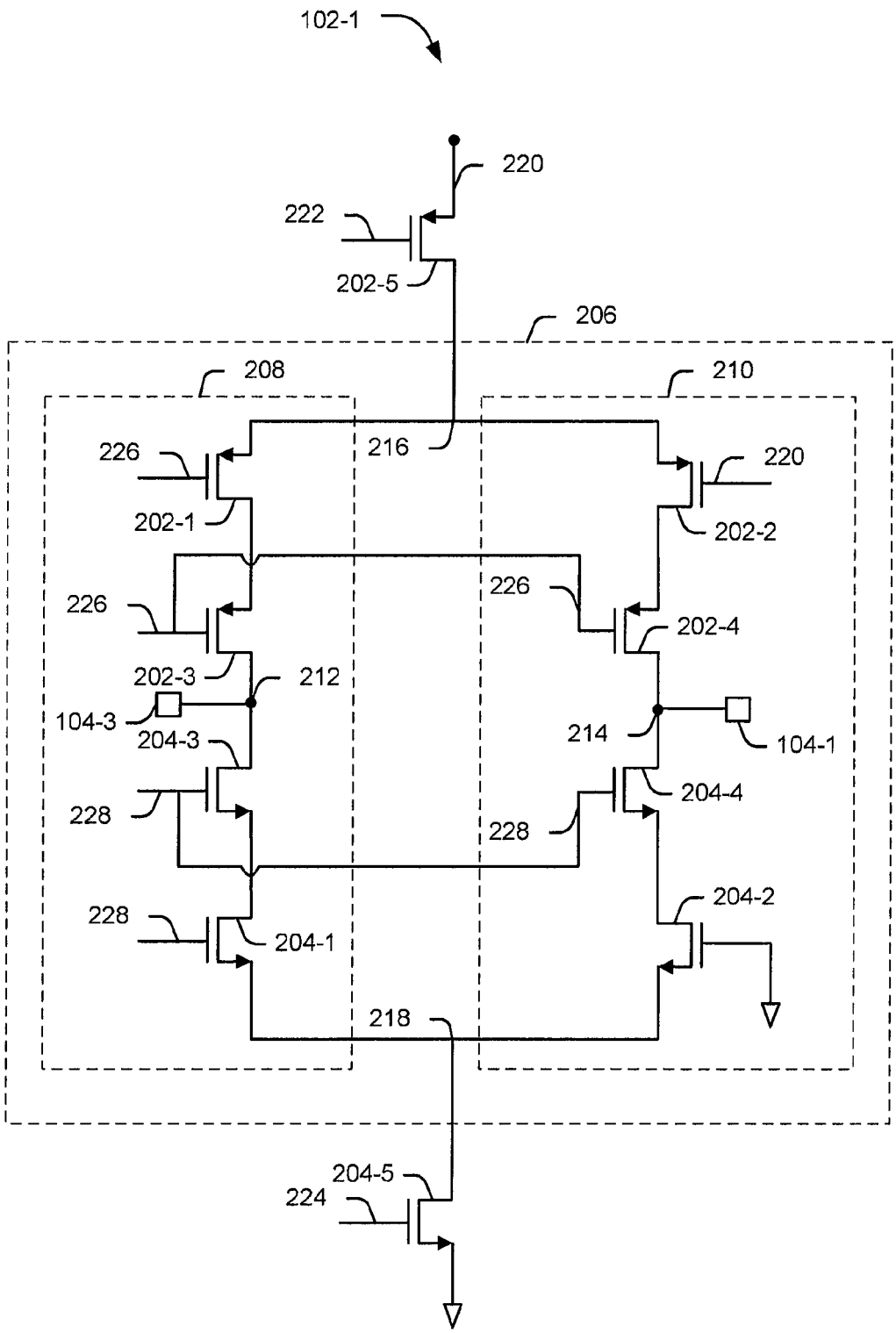
FIG. 2 illustrates an exemplary circuit diagram of a driver circuit implemented using a shared driver circuit configuration.

FIG. 2 illustrates an exemplary circuit diagram of the driver circuit in a shared driver circuit (SDC) configuration. Though the description is provided with reference to the driver circuit 102-1, it will be understood that the driver circuit 102-2 can be implemented in a similar manner.

In an implementation, the driver circuit 102-1, in the SDC configuration, includes p-channel MOSFETs, hereinafter referred to as pMOSs, 202-1, 202-2, 202-3, 202-4, and 202-5. The driver circuit 102-1 also includes n-channel MOSFETs, hereinafter referred to as nMOSs, 204-1, 204-2, 204-3, 204-4, and 204-5. The pMOSs 202-1, 202-2, 202-3, 202-4, and 202-5, are collectively referred to as pMOSs 202 hereinafter. Similarly, the nMOSs 204-1, 204-2, 204-3, 204-4, and 204-5, are collectively referred to as nMOSs 204 hereinafter.

Further, the driver circuit 102-1 includes a combined cascode circuit 206 having a first cascode circuit and a second cascode circuit. The first cascode circuit can be realized with the help of the pMOSs 202-1 and 202-2 and the nMOSs 204-1 and 204-2. The second cascode circuit can be realized with the help of the pMOSs 202-3 and 202-4 and the nMOSs 204-3 and 204-4. For discussion purposes, the combined cascode circuit 206 can be represented as being made of two stages. The pMOSs 202-1 and 202-3 and the nMOSs 204-1 and 204-3 represent a first stage 208, while the pMOSs 202-2 and 202-4 and the nMOSs 204-2 and 204-4 represent a second stage 210 of the combined cascode circuit 206.

In said implementation, in the first stage 208, drains of the pMOS 202-1 and the nMOS 204-1 can be coupled to respective sources of the pMOS 202-3 and the nMOS 204-3. Also, drains of the pMOS 202-3 and the nMOS 204-3 are coupled to each other and to the pin interface 104-3 at a node 212 to provide an output of the first stage 208. Similarly, in the second stage 210, drains of the pMOS 202-2 and the nMOS 204-2 can be coupled to sources of the pMOS 202-4 and the nMOS 204-4 respectively. Also, drains of the pMOS 202-4 and the nMOS 204-4 are coupled to each other and to the pin interface 104-1 at a node 214 to provide an output of the second stage 210. Further, the first stage 208 and the second stage 210 can be connected to each other by coupling the source of the pMOS 202-1 to the source of the pMOS 202-2, and coupling the source of the nMOS 204-1 with the source of the nMOS 204-2. Also, gates of the pMOSs 202-3 and 202-4 can be coupled to each other. Similarly, the gates of the nMOSs 204-3 and 204-4 can be coupled to each other.

Further, the pMOS 202-5 and the nMOS 204-5 are connected to the combined cascode circuit 206. For this, drain of the pMOS 202-5 can be connected to the sources of the pMOSs 202-1 and 204-2 at a node 216, while drain of the nMOS 204-5 can be connected to the sources of the nMOSs 204-1 and 204-2 at a node 218. The source of the pMOS 202-5 can be provided with a supply voltage 220, hereinafter referred to as $V_A$ 220, from a battery, while the source of the nMOS 204-5 can be grounded. Also, the gate of the pMOS 202-5 can be fed with an input signal 222, while the gate of the nMOS 204-5 can be supplied with an input signal 224. In an implementation, the input signals 222 and 224 can be supplied from various circuits such as a radio frequency (RF) circuit or a digital audio circuit. These input signals 222 and 224 can be level shifted to perform a desired operation using techniques known in the art.

In operation, the driver circuit 102-1 can drive the pin interfaces 104-1 and 104-3 in a mutually exclusive manner. For example, the pin interface 104-3 can be selectively operated, while the pin interface 104-1 can be tri-stated. For this, the first stage 208 can be activated, while the second stage 210 can be deactivated. Additionally, the gates of the pMOS 202-5 and the nMOS 204-5 can be supplied with level shifted input signals 222 and 224, respectively, for providing a required threshold voltage to activate the pMOS 202-5 and the nMOS 204-5. The activated pMOS 202-5 and the nMOS 204-5 facilitate propagation of the $V_A$ 220 from the pMOS 202-5 to the first stage 208 and the second stage 210 through the respective sources of the pMOSs 202-1 and 202-2.

Further, in order to activate the first stage 208 of the combined cascode circuit 206, a low voltage input signal 226, hereinafter referred to as $V_B$-L signal 226, having a logic level zero can be applied at the gates of the pMOSs 202-1 and 202-3. Also, the $V_B$-L signal 226 gets transmitted to the gate of the pMOS 202-4 due to the configuration explained earlier. Simultaneously, a high voltage input signal 228, hereinafter referred to as $V_B$-H signal 228, having a logic level one can be applied at the gates of the nMOSs 204-1 and 204-3. The $V_B$-H signal 228 is also transmitted to the gate of the nMOS 204-4. However, it is to be noted that the second stage 210 is to be deactivated at the same time in order to tri-state the pin interface 104-1 while the pin interface 104-3 is being used.

In order to deactivate the second stage 210, the $V_A$ signal 220, which has a high voltage, or in other words a logic level one, can be applied at the gate of the pMOS 202-2, while the gate of the nMOS 204-2 can be grounded. Due to activation of the first stage 208 and a simultaneous deactivation of the second stage 210, the pin interface 104-3 can operate while the pin interface 104-1 remains floating. In other words, the pin interface 104-1 is isolated.

A conventional SDC configuration, which includes only the first cascode circuit, is unable to provide a float voltage at the pin interface 104-1. In comparison to a conventional SDC configuration, the proposed SDC configuration facilitates a float voltage at the pin interface 104-1 with the help of an additional cascode circuit, i.e., the second cascode circuit.

In the first cascode circuit, although the $V_A$ signal 220 applied at the gate of the pMOS 202-2 switches off the pMOS 202-2, the $V_A$ signal 220 can get coupled to the drain of the pMOS 202-2 due to an inherent coupling between the gate and the drain of the pMOS 202-2. Such an inherent coupling causes an unwanted voltage to appear at the drain of the pMOS 202-2. This unwanted voltage can lead to a deviation in the float voltage at the pin interface 104-1, if applied alone, resulting in an unreliable operation at the pin interface 104-1. However, in the described SDC configuration, due to the second cascode circuit, there is a voltage drop between gate and source of the pMOS 204-4. Hence, a reliable float voltage having a required value can be conveyed to the pin interface 104-1 from the drain of the pMOS 202-4 through the node 214. Therefore, a float voltage can be provided to the pin interface 104-1 with the help of the second cascode circuit to reliably isolate the pin interface 104-1.

It will be understood that the driver circuit 102-2 can also be implemented using a similar SDC configuration having two cascode circuits to provide a reliable float voltage at the correspondingly coupled pin interfaces 104-2 and 104-4, as and when required.

Figure 3:
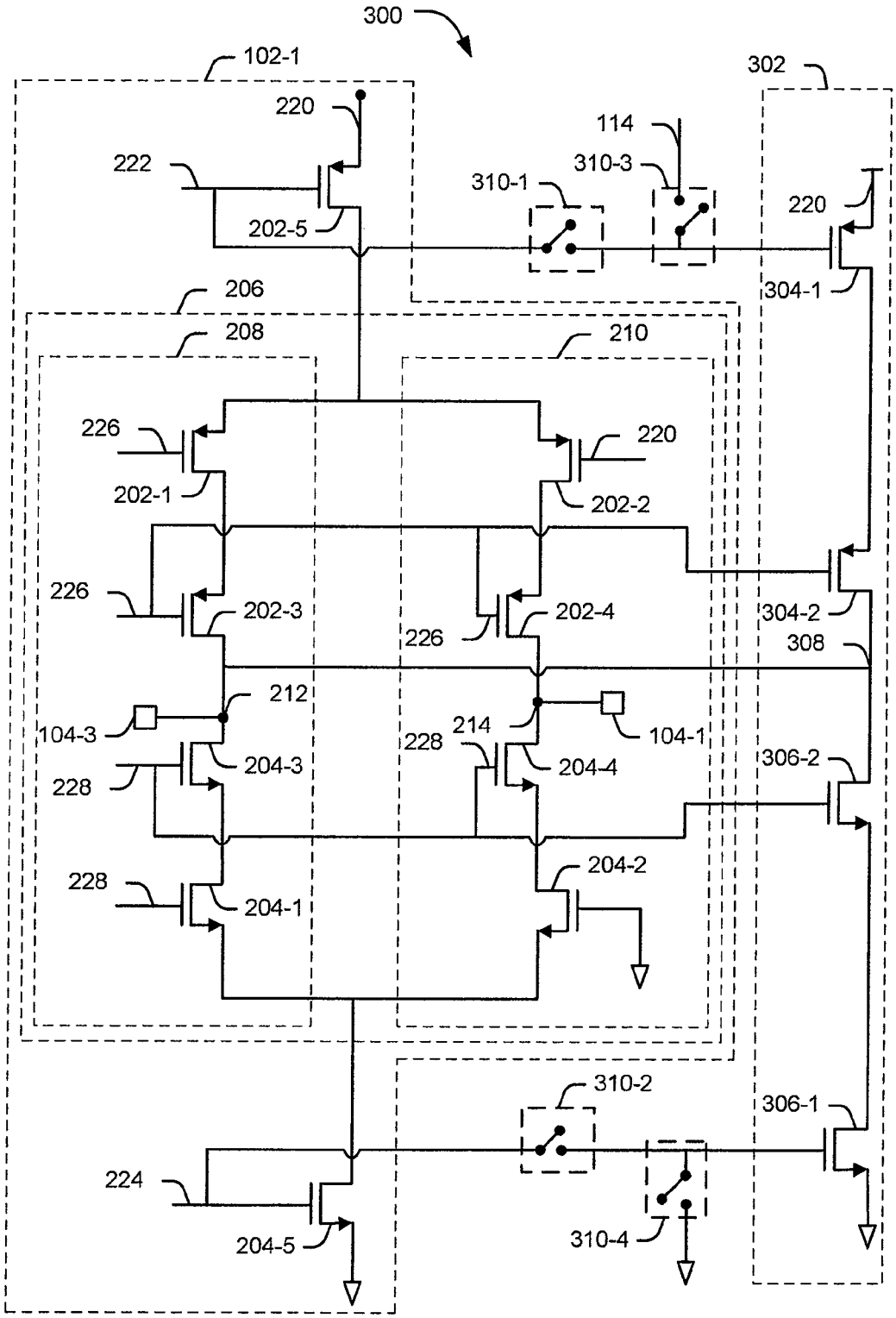
FIG. 3 illustrates an exemplary coupling of a high power speaker in the exemplary low pin architecture.

FIG. 3 illustrates an exemplary circuit 300 for coupling the high power speaker 114 in a low pin architecture 100. Though the description is provided with reference to coupling of the high power speaker 114 with the driver circuit 102-1, it will be understood that the high power speaker 114 can be coupled to the driver circuit 102-2 in a similar manner.

In an implementation, the low pin architecture 100 includes the driver circuit 102-1 in the SDC configuration, which is realized with the help of the pMOSs 202 and the nMOSs 204. The driver circuit 102-1 operates the pin interfaces 104-1 and 104-3 in a mutually exclusive manner, as explained earlier in the description of FIG. 2. Further, as described earlier with reference to FIG. 1, the high power speaker 114 shares the pin interface 104-3 with the earphone speaker 116-1. For this, the low pin architecture 100 further includes a cascode arm 302, which is coupled to the high power speaker 114.

The cascode arm 302 can be realized with the help of pMOSs 304-1 and 304-2 and nMOSs 306-1 and 306-2. Drains of the pMOS 304-1 and the nMOS 306-1 can be connected to sources of the pMOS 304-2 and the nMOS 306-2, respectively. Drains of the pMOS 304-2 and the nMOS 306-2 can be connected to each other at a node 308. The node 308 is, in turn, connected to the drains of the pMOS 202-3 and the nMOS 204-3.

Further, gates of the pMOS 304-2 and the nMOS 306-2 can be connected to the gates of the pMOS 202-3 and the nMOS 204-3, respectively. Similarly, gates of the pMOS 304-1 and the nMOS 306-1 can be coupled to the gates of the pMOS 202-5 and the nMOS 204-5 through respective switches 310-1 and 310-2. The gate of the pMOS 304-1 can also be coupled to the high power speaker 114 through a switch 310-3, while a corresponding ground connection can be coupled to the gate of the nMOS 306-1 through a switch 310-4. The switches 310-1, 310-2, 310-3, and 310-4 are collectively referred to as switches 310 hereinafter.

Further, the source of the pMOS 304-1 can be supplied with the $V_A$ signal 220 and the source of the nMOS 306-1 can be grounded. Such coupling of the cascode arm 302 with the driver circuit 102-1, realized with the help of pMOSs 202 and the nMOSs 204, through the switches 310 can facilitate selective driving of the high power speaker 114 or the earphone speaker 116-1 (not shown in this figure) at the pin interface 104-3. In other words, the cascode arm 302 can be asymmetrically driven by the driver circuit 102-1 to activate the high power speaker 114 when desired. The described implementation of the cascode arm 302 avoids any unwanted voltage swing at the pin interface 104-3. The unwanted voltage swing may have otherwise appeared due to a signal received from the pin interface 104-2, through the high power speaker 114 coupled at the pin interfaces 104-2 and 104-3, as discussed in FIG. 1. This asymmetrical driving of the pin interface 104-3 causes a reduction in the number of cascode arms used to drive the high power speaker 114, thereby further reducing the space constraint on the IC.

In operation, the high power speaker 114 can be operated by activating the pin interface 104-3 through the first stage 208 of the combined cascode circuit 206 and the cascode arm 302. For this, when the pMOS 202-5 and the nMOS 204-5 are activated, the switches 310-1 and 310-2 can be closed using a variety of mechanisms known in the art. As a result, the input signals 222 and 224, which are applied at the gates of the pMOS 202-5 and the nMOS 204-5, can be supplied to the gates of the pMOS 304-1 and the nMOS 306-1.

Additionally, when the first stage 208 is activated to drive the pin interface 104-3, the $V_B$-L signal 226 is applied at the gate of the pMOS 304-2 and the $V_B$-H signal 228 is applied at the gate of the nMOS 306-2. Accordingly, the pMOSs 304-1 and 304-2 and the nMOSs 306-1 and 306-2 can be activated to activate the cascode arm 302. Then, an output of the first stage 208 through the drains of the pMOS 202-3 and the nMOS 204-3 can be provided at the node 308 in the cascode arm 302. The output of the first stage 208 is lowered in voltage at the pin interface 104-3 due to an added impedance on account of two cascode circuits. At this instant, the switches 310-3 and 310-4 can be closed to drive the high power speaker 114. When the switches 310 are closed, the cascode arm 302 is activated to reduce the impedance at the pin interface 104-3 and correspondingly lower the impedance at the node 308. As a result, the high power speaker 114 is driven substantially mutually exclusive to the earphone speaker 116-1 at the pin interface 104-3.

Further, when the second stage 210 of the combined cascode circuit 206 is activated to drive the pin interface 104-1, the switches 310 are opened. The switches 310 can also be opened when the earphone speaker 116-1 is to be driven mutually exclusive to the high power speaker 114. Accordingly, the cascode arm 302 gets deactivated to tri-state the high power speaker 114. Since the high power speaker 114 can be tri-stated by regulating the switches 310, the impedance added to the first stage 208 by the cascode arm 302 can be significantly reduced during operation of the earphone speakers 116. Also, the space occupied by any separate component, for example, resistors, transistors, etc., to provide a required impedance to the first stage 208 can be substantially saved due to the coupling of the cascode arm 302, as explained earlier.

It will be understood that the high power speaker 114 can be driven by another cascode arm, which is similar to the cascode arm 302, at the pin interface 104-2.

Figure 4:
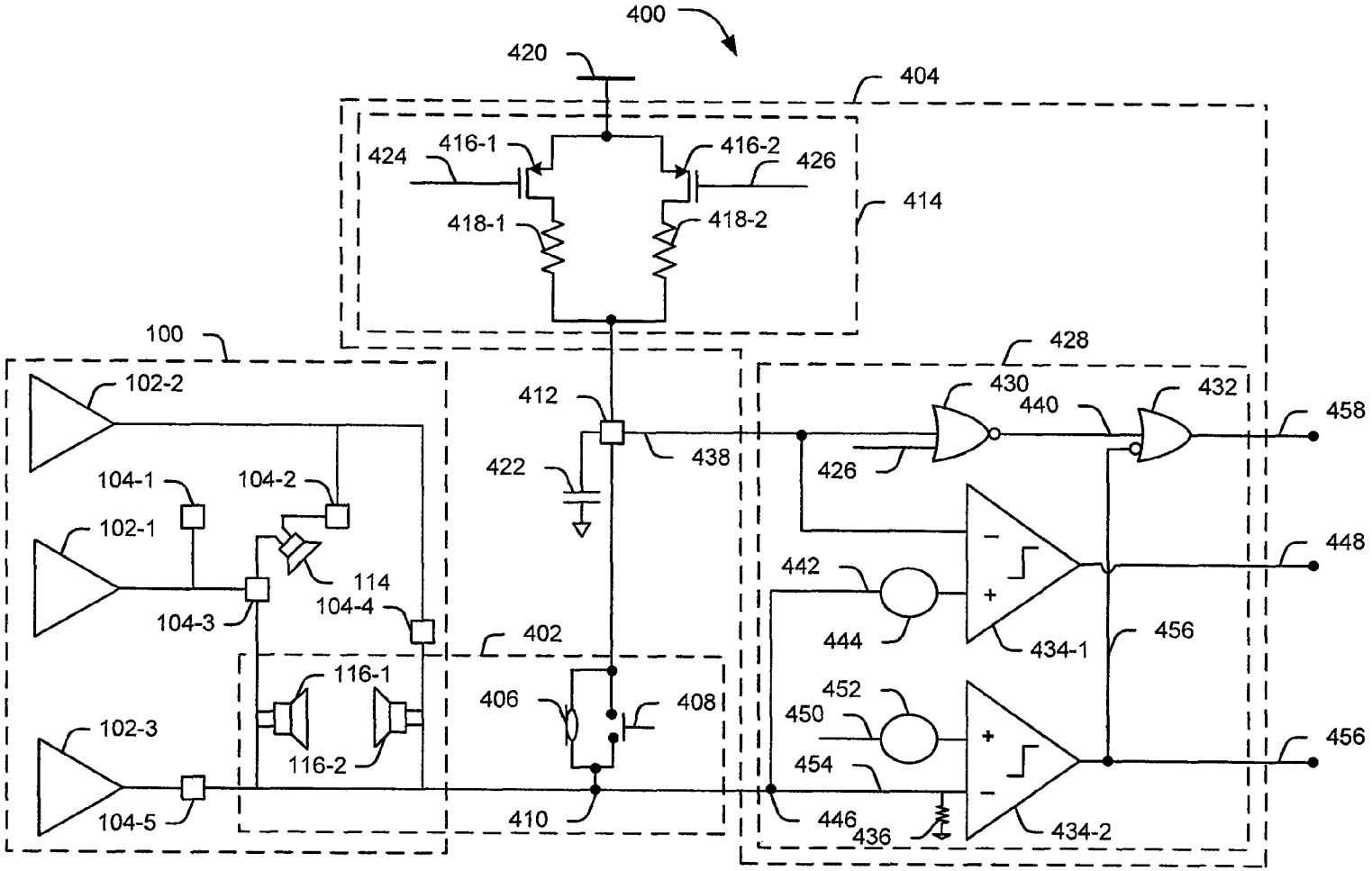
FIG. 4 illustrates an exemplary application of the low pin architecture of FIG. 1.

FIG. 4 illustrates an exemplary circuit 400 showing an application of the low pin architecture 100 of FIG. 1. In an implementation, the circuit 400 includes the low pin architecture 100 for coupling of the low power speaker 112 (not shown in this figure), the high power speaker 114, and the earphone speakers 116 with the pin interfaces 104. These pin interfaces 104 can be driven by the driver circuits 102, as explained in the description of FIG. 1 and FIG. 2. The circuit 400 further includes a headset 402 and a headset detection circuit 404. The headset 402 includes a microphone 406 and a hook-switch 408 that is connected in parallel with the microphone 406. The microphone 406 and the hook-switch 408 can be coupled to the pin interface 104-5 through a node 410. The microphone 406 and the hook-switch 408 are also coupled to an external pin interface 412, hereinafter referred to as EPI 412. The headset 402 also includes the earphone speakers 116, which are coupled to the pin interfaces 104-3, 104-4, and 104-5 as already explained in the description of FIG. 1.

Though the microphone 406 and the earphone speakers 116 are described as being a part of the same headset 402, it will be understood that they can be independent components as well.

The headset detection circuit 404 can be coupled to the headset 402 through the EPI 412. The headset detection circuit 404 includes a pull-up circuit 414 including pMOSs 416-1 and 416-2 and pull-up resistors 418-1 and 418-2. Sources of the pMOSs 416-1 and 416-2 can be connected to each other and to a pull-up supply voltage 420. Drains of the pMOSs 416-1 and 416-2 can be coupled to the EPI 412 through the pull-up resistors 418-1 and 418-2, respectively. In one implementation, the pull-up resistor 418-2 is larger than the pull-up resistor 418-1. The EPI 412 is also connected to a capacitor 422 to minimize noise in the voltage applied at the EPI 412. Further, gate of the pMOS 416-1 can be fed with a hook-switch enable signal 424, hereinafter referred to as HSE signal 424, while gate of the pMOS 416-2 can be supplied with a microphone enable signal 426, hereinafter referred to as ME signal 426. The HSE signal 424 and the ME signal 426 can be clock signals provided by a control circuit (not shown in the figure) for detecting activation of the headset 402.

The headset detection circuit 404 further includes a logic circuit 428 having a NOR gate 430, an OR gate 432, a hook-switch comparator 434-1, a masking comparator 434-2, and a large pull-down resistor 436. The NOR gate 430 receives an input signal 438 as a first input from the EPI 412, while the ME signal 426 can be applied as a second input to the NOR gate 430 to provide an output signal 440. The hook-switch comparator 434-1 receives the input signal 438 at a negative input. The hook-switch comparator 434-1 also receives an input signal 442 at a positive input with an applied input offset voltage 444. The input signal 442 is received from a node 446, which is coupled to the pin interface 104-5 through the node 410. The hook-switch comparator 434-1 provides an output signal 448. When the input signal 438, which is applied at the negative input, has a lower voltage than the sum of the input signal 442 and the offset voltage 444 applied at the positive input, the hook-switch comparator 434-1 provides the output signal 448 at a high voltage and vice versa.

For illustration purposes the input signal 438 is also referred to as an external voltage as it is the voltage at the EPI 412. Further, the pin interface 104-5, to which the headset is connected, is also referred to as an internal pin interface and the voltage at the pin interface 104-5 is also referred to as an internal voltage.

In addition, the masking comparator 434-2 receives a common mode reference signal 450, which has an applied input offset voltage 452, at a positive input. The sum of the common mode reference voltage 450 and the input offset voltage 452 is also referred to as a reference voltage. Also, the masking comparator 434-2 receives a common mode signal 454 from the pin interface 104-5, through the nodes 410 and 446, at a negative input. Further, the masking comparator 434-2 provides an output signal 456. When the common mode reference signal 450 applied at the positive input has a lower voltage than that of the common mode signal 454 applied at the negative input, the masking comparator 434-2 provides the output signal 456 at a low voltage and vice versa.

The OR gate 432 receives the output signal 440 of the NOR gate 430 as a first input, while the output signal 456 of the masking comparator 434-2 can be inverted and fed to the OR gate 432 as a second input. The OR gate 432 provides an output signal 458, which indicates the availability of the microphone 406.

The large pull-down resistor 436 ensures that the voltage at the pin interface 104-5 goes to ground when the headset 402 is disconnected from the pin interface 104-5. Accordingly, the common mode signal 454 can be received from the pin interface 104-5 at a low voltage. The large value of the pull-down resistor 436 facilitates normal operation of the driver circuit 102-3, when the corresponding pin interface 104-5 is not floating. On the other hand, absence of the large pull-down resistor 436 can cause a high voltage at the node 446 when the pin interface 104-5 is floating. This high voltage at the node 446 can interfere with reliable operation of the headset detection circuit 404 when the pin interface 104-5 is floating.

In operation, as soon as the headset 402 is coupled to the pin interfaces 104-3, 104-4, 104-5, and the EPI 412, the headset detection circuit 404 begins to operate on the headset 402. At this instant, the pull-up circuit 414 included in the headset detection circuit 404 is activated. Accordingly, the gates of the pMOS 416-1 can be supplied with the HSE signal 424, which is at low voltage or logic level zero. Subsequently, the pMOS 416-2 can be supplied with the ME signal 426, which is also at low voltages or logic level zero. As a result, the pMOSs 416-1 and 416-2 can be activated at different time intervals to propagate the pull-up supply voltage 420 through the pull-up resistors 418-1 and 418-2 to the EPI 412. This will be described later with reference to FIG. 5.

When the headset 402 is coupled to the EPI 412, a voltage drop occurs through the pull-up resistors 418-1 and 418-2 at the EPI 412, as will be described later with reference to FIG. 5. As only the microphone 406 is connected and the hook switch 408 is not pressed, the voltage at the EPI 412 drops to a value lower than a microphone detection threshold voltage, but is higher than a hook switch detection threshold voltage. The microphone detection threshold voltage is also the threshold comparator voltage of the NOR gate 430. In one implementation, when the NOR gate 430 receives the ME signal 426 at a low voltage and the input signal 438 is below the microphone detection threshold voltage, the output signal 440 of the NOR gate 430 is high. Since the output signal 440 is provided as an input signal to the OR gate 432, the output 458 of the OR gate 432 is also high, indicating the availability of the microphone. In such a case, the availability of the microphone 406 can be detected irrespective of the output of the masking comparator 434-2.

Further, the input signal 438 can be provided to the negative input of the hook-switch comparator 434-1. The hook-switch comparator 434-1 receives the input signal 442 at a low voltage at its positive input. As discussed, the input signal 442 having the input offset voltage 444 can be provided to the hook-switch comparator 434-1 from the pin interface 104-5 through the node 446. The input offset voltage 444 is intentionally added and corresponds to the hook-switch detection threshold voltage. Accordingly, the output of the hook-switch comparator 434-1 has low voltage, when:

$$\text{If } V(438)>V(442)+V(444); V(448)=\text{low} \quad (1)$$

As evident from equation (1), the output 448 of the hook-switch comparator 434-1 is at a low voltage when the voltage of the input signal 438 is more than the summation of the voltage of input signal 442 and the input offset voltage 444, and vice versa. As discussed earlier, as the hook-switch 408 is not pressed, the voltage 438 is greater than the hook-switch detection threshold voltage. Therefore, on account of the voltage at the negative input being higher than the voltage at the positive input, the hook-switch comparator 434-1 provides the output signal 448 at a low voltage. This output signal 448 indicates that the hook-switch 408 is switched OFF.

Further, when the hook-switch 408 is pressed, the microphone 406 draws current from the EPI 412 for its operation and, as a result, the voltage 438 drops to a value below the hook-switch detection threshold voltage. In such a case, the hook-switch comparator 434-1 provides the output signal 448 at a high voltage, indicating that the hook-switch 408 is ON.

In an implementation, the activation of the headset 402 can be reliably detected with the help of the headset detection circuit 404, even when the pin interface 104-5 is at a high float voltage, to facilitate simultaneous use of both the high power speaker 114 and the earphone speakers 116.

In operation, consider a state where the high power speaker 114 is being operated while the headset 402 including the earphone speakers 116 and the microphone 406, both coupled to the pin interface 104-5, is not connected. When the headset 402 is connected and the microphone 406 is not in use, i.e., the hook-switch 408 is not pressed, both the earphone speakers 116 and the high power speaker 114 are being driven. As a result a high float voltage can occur at the pin interface 104-5. Due to this, the voltage at the EPI 412 may not drop below the microphone detection threshold voltage when the headset 402 is connected and hence the output 440 from the NOR gate 430 may be low. In such a case, the masking comparator 434-2 is used to detect the availability of the microphone 406.

The masking comparator 434-2 receives the common mode reference signal 450, having the input offset voltage 452, at the positive input of the masking comparator 434-2. The negative input of the masking comparator 434-2 receives the common mode signal 454 from the pin interface 104-5 through the nodes 446 and 410. If the voltage of the common mode signal 454 is higher than the combined voltages of the common mode reference signal 450 and the input offset voltage 452, the output signal 456 of the masking comparator 434-2 goes low, and vice versa.

This output signal 456, having a low voltage, is inverted to provide an inverted output signal at a high voltage, i.e., having logic level one. The inverted output signal is applied as the second input to the OR gate 432, which receives the output signal 440 as the first input at a low voltage from the NOR gate 430. Therefore, due to application of a low voltage at the first input and a high voltage at the second input, the OR gate 432 provides the output signal 458 at a high voltage. The output signal 458 having a high voltage indicates that the microphone 406 in the headset 402 is available. Thus the mask comparator 434-2 can be used to reliably determine the availability of the headset 402 even when the pin interface 104-5 is at a high float voltage.

Further, when the pin interface 104-5 is at a high float voltage, the hook-switch 408 can be closed and correspondingly, the microphone 406 can be activated. Due to the activated microphone 406 drawing power from the EPI 412, the voltage of the input signal 438 drops below the hook-switch detection threshold value.

Accordingly, in the logic circuit 428, the NOR gate 430 receives the input signal 438 at a low voltage as the first input from the EPI 412 and the ME signal 426 at a low voltage as the second input. Due to application of comparable low voltages at both the first and the second inputs, the NOR gate 430 provides the output signal 440 at a high voltage, which is then applied to the OR gate 432 as the first input.

Further, the input signal 438 at a low voltage is also applied at the negative input of the hook-switch comparator 434-1, while the input signal 442 at a high voltage can be applied at the positive input of the hook-switch comparator 434-1. As a result, the hook-switch comparator 434-1 provides the output signal 448 at a high voltage, which indicates that the hook-switch 408 is closed or ON.

Figure 5:
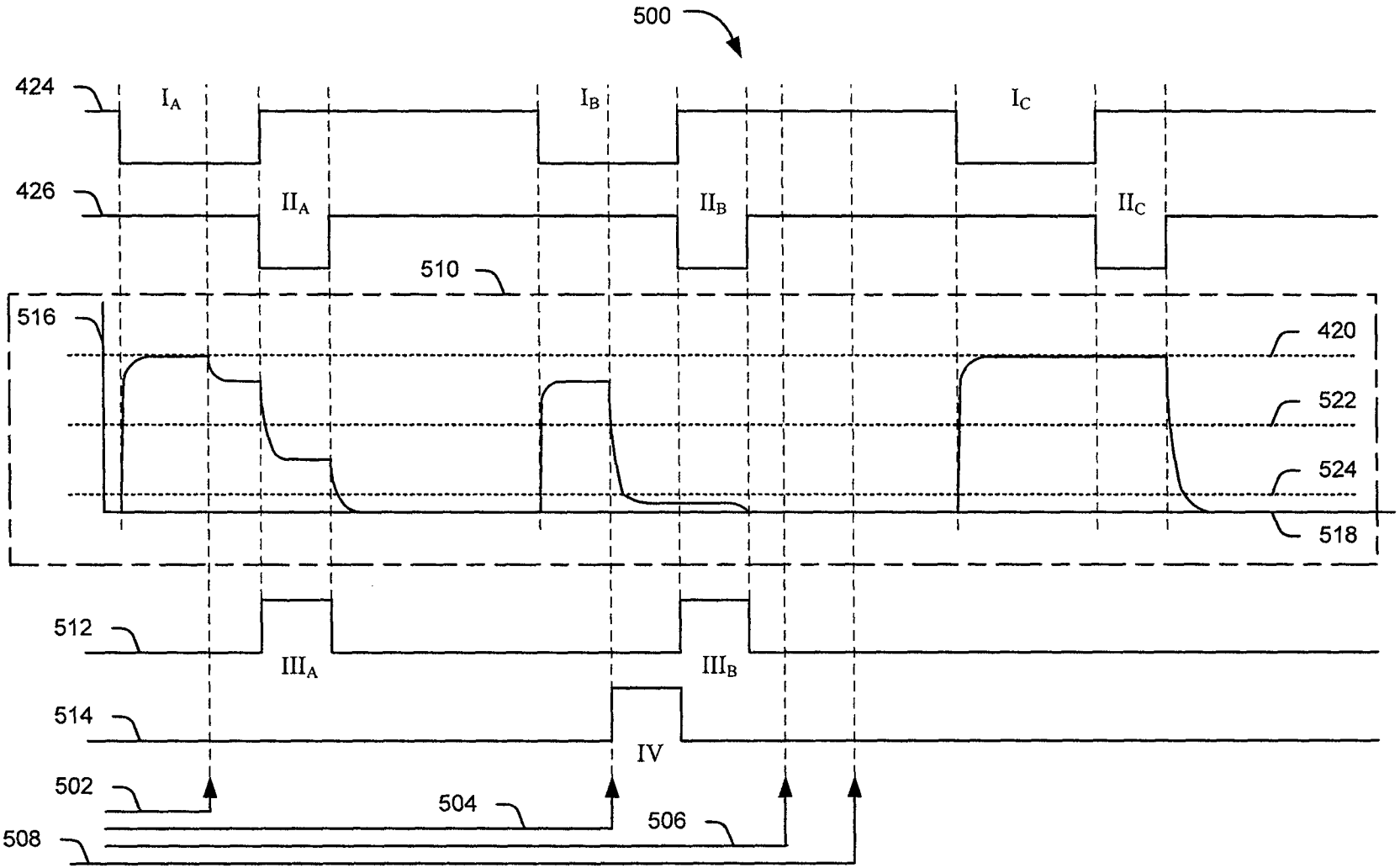
FIG. 5 illustrates an exemplary timing diagram for the application of FIG. 4.

FIG. 5 illustrates an exemplary timing diagram 500 for the circuit 400 of FIG. 4. The timing diagram 500 illustrates a relationship between voltage at the EPI 412 and various clock signals during a number of events for example, a first event 502, a second event 504, a third event 506, and a fourth event 508. The first event 502 corresponds to coupling of the headset 402 with the EPI 412, the second event 504 corresponds to closing of the hook-switch 408, the third event 506 corresponds to releasing of the hook-switch 408, and the fourth event 508 corresponds to decoupling of the headset 402 from the EPI 412.

Further, the timing diagram 500 includes four clock signals and a graph 510 representing a variation in the voltage at the EPI 412 with time, based on the events mentioned above. The four clock signals include the HSE signal 424 and the ME signal 426, which have negative pulses, and a headset ON signal 512 and a hook-switch ON signal 514, which have positive pulses. The negative pulses and positive pulses of these clock signals are the active pulses. In other words, the negative pulses of the HSE signal 424 and the ME signal 426, and the positive pulses of the headset ON signal 512 and the hook-switch ON signal 514 can facilitate a change in voltage at the EPI 412.

In an implementation, the ME signal 426 and the headset ON signal 512 can be produced at the end of the active pulse of the HSE signal 424. The HSE signal 424, the ME signal 426, the headset ON signal 512, and the hook-switch ON signal 514 can be produced continuously and periodically by a control circuit (not shown in the figure). However, the headset ON signal 512 can be produced only when the headset 402 is coupled with the EPI 412 and the hook-switch ON signal 514 can be produced only when the hook-switch 408 is closed.

The graph 510 shows the voltage at the EPI 412 on Y axis 516 as a function of time, which is plotted on X axis 518. Voltage at the Y axis 516 can be represented with respect to the pull-up supply voltage 420, a first threshold voltage 522, and a second threshold voltage 524. The pull-up supply voltage 420 is the voltage supplied to the pull-up circuit 414. The first threshold voltage 522 is the threshold voltage for reliable detection of the microphone 406.

When the ME signal 426 having a low voltage is applied to activate the pMOS 416-2, a voltage of the input signal 438 is compared with the first threshold voltage 522 at the NOR gate 430 to reliably detect the microphone 406. Accordingly, the voltage of the input signal 438 falling below the first threshold voltage 522, indicates presence of the headset 402.

On the other hand, the second threshold voltage 524 is the hook-switch detection threshold voltage 444 of the hook-switch comparator 434-1 for reliable detection of the second event 504. When the HSE signal 424 having a low voltage is applied to activate the pMOS 416-1, the voltage of the input signal 438 is compared with the second threshold voltage 524 by the hook-switch comparator 434-1 to reliably detect the second event 504. Accordingly, if the voltage of the input signal 438 falls below the second threshold voltage 524, the hook-switch comparator 434-1 generates an output signal 448 at a high voltage, indicating a hook-switch press event.

In an implementation, the graph 510 can be described with the help of the clock signals and the events described earlier. Initially, during an active pulse $I_A$ of the HSE signal 424, the voltage at the EPI 412 can be pulled up to the pull-up supply voltage 420. When the first event 502 occurs, there can be a small voltage drop at the EPI 412 through the pull-up resistor 418-1 in the pull-up circuit 414. So, due to this voltage drop, the voltage at EPI 412 is lower than the pull-up supply voltage 420. However, since the pull-up resistor 418-1 is much smaller than the pull-up resistor 418-2, the voltage is higher than the first threshold voltage 522.

Subsequently, at the end of the active pulse $I_A$ of the HSE signal 424, an active pulse $II_A$ of the ME signal 426 can be produced. At this instant, when an active pulse $III_A$ of the headset ON signal 512 is generated, there can be a further voltage drop at the EPI 412 through the pull-up resistor 418-2 due to the headset 402 drawing power from the EPI 412. Due to a large size of the pull-up resistor 418-2 than the pull-up resistor 418-1, the voltage drop for the active pulse $III_A$ of the headset ON signal 512 is more than the voltage drop for the active pulse $I_A$ of the HSE signal 424. Therefore, the voltage at the EPI 412 is lower than the first threshold voltage 522, but higher than the second threshold voltage 524, indicating that the microphone 406 is connected but not the hook switch 408. At the end of the active pulse $II_A$ of the ME signal 426, the voltage at the EPI 412 gradually goes to ground as both the active pulses $I_A$ and $II_A$ of the HSE signal 424 and the ME signal 426 are inactive.

In the next cycle, since the headset 402 is already coupled to the EPI 412, the voltage at the EPI 412 can still be lower than the pull-up supply voltage 420 during an active pulse $I_B$ of the HSE signal 424. At this instant, an occurrence of the second event 504 can cause the voltage at the EPI 412 to drop below the second threshold voltage 524. The occurrence of the second event 504 can be signaled by an active pulse IV of the hook-switch ON signal 514. The activated hook switch 408 of the headset 402 draws power from the EPI 412 which creates the voltage drop at the EPI 412. Subsequently, at the end of the active pulse $I_B$ of the HSE signal 424, the active pulses $II_B$ and $III_B$ can be produced. At this instant, there can be a substantial voltage drop at the EPI 412 on account of the headset 402 drawing power from the EPI 412. The increased voltage drop is due to closing of the hook-switch 408, which is a small resistance switch, between the events 504 and 506. After the end of the active pulse $II_B$ of the ME signal 426, the third event 506 can occur indicating releasing of the hook-switch 408, which deactivates the microphone 406. Then, the fourth events 508 can occur indicating decoupling of the headset 402 from the EPI 412 respectively.

In the succeeding cycle, since the hook-switch 408 is released and the headset 402 is also decoupled from the EPI 412, there is no voltage drop at the EPI 412 during an active pulse $I_C$ of the HSE signal 424. Accordingly, the EPI 412 can be pulled up to the pull-up supply voltage 420. Also, at the end of the active pulse $I_C$ of the HSE signal 424, when an active pulse $II_C$ of the ME signal 426 is generated, no deviation in the voltage at the EPI 412 from the pull-up supply voltage 420 is observed. Subsequently, at the end of the active pulse $II_C$ of the ME signal 426, the voltage at the EPI 412 is gradually grounded.

Although embodiments for coupling of speakers with integrated circuits have been described in language specific to structural features and/or methods, it is to be understood that the appended claims are not necessarily limited to the specific features or methods described. Rather, the specific features and methods are disclosed as exemplary implementations for the coupling of speakers with integrated circuits.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

We claim:

1. A system comprising:

first, second, and third pin interfaces;

a first device coupled between the first and second pin interfaces;

a second device that is coupled to the first pin interface and shares the first pin interface with the first device;

a first driver circuit shared between the first pin interface and the third pin interface, wherein the first driver circuit includes a first combined cascode circuit including at least two cascode circuits to selectively drive the first pin interface or the third pin interface;

a fourth pin interface and a second driver circuit shared between the second pin interface and the fourth pin interface, wherein the second driver circuit includes a second combined cascode circuit to selectively drive one of the second pin interface and the fourth pin interface;

a third device, wherein the second device is coupled to the fourth pin interface and shares the fourth pin interface with the third device;

wherein the first device is a low power speaker, the second device is a high power speaker and the third device is an earphone speaker coupled to the mobile device.

2. The system as claimed in claim 1, further comprising a cascode arm, wherein the first driver circuit is coupled to the cascode arm to selectively drive the second device through the first pin interface.

3. The system as claimed in claim 1, further comprising a fourth pin interface and a second driver circuit shared between the second pin interface and the fourth pin interface, wherein the second driver circuit includes a second combined cascode circuit to selectively drive one of the second pin interface and the fourth pin interface.

4. The system as claimed in claim 3, further comprising a third device, wherein the second device is coupled to the fourth pin interface and shares the fourth pin interface with the third device.

5. The system as claimed in claim 3, further comprising a cascode arm, wherein the second driver circuit is coupled to the cascode arm to selectively drive the second device through the fourth pin interface.

6. The system as claimed in claim 5, further comprising:

a fifth pin interface for interfacing with a headset having a microphone, a hook switch and speakers; and a third driver circuit coupled to the fifth pin interface.

7. The system as claimed in claim 6, further comprising:

a sixth pin interface for interfacing with the microphone and the hook switch; and a head set detection circuit configured to detect the microphone and an activation of the hook switch.

8. The system as claimed in claim 7, wherein the headset detection circuit includes a logic circuit, the logic circuit comprising:

a hook-switch comparator configured to detect the activation of the hook-switch based on a comparison of an external voltage at the sixth pin interface and a sum of a voltage at the fifth pin interface and a hook-switch detection threshold voltage; and a masking comparator configured to facilitate detection of the microphone based on a comparison of the voltage at the fifth pin interface and a reference voltage.

* * * * *

UNITED STATES PATENT AND TRADEMARK OFFICE

CERTIFICATE OF CORRECTION

PATENT NO. : 8,787,588 B2
APPLICATION NO. : 12/713083
DATED : July 22, 2014
INVENTOR(S) : Sanjeev Ranganathan et al.

It is certified that error appears in the above-identified patent and that said Letters Patent is hereby corrected as shown below:

On the title page, Item (73), please delete the Assignee "ST-Ericsson PVT. Ltd." and insert --ST-Ericsson India PVT. Ltd.--

Signed and Sealed this
Fourteenth Day of October, 2014

Michelle K. Lee

Michelle K. Lee
*Deputy Director of the United States Patent and Trademark Office*